US011198578B2

(12) United States Patent
Suga

(10) Patent No.: US 11,198,578 B2
(45) Date of Patent: Dec. 14, 2021

(54) SHEET FEEDING DEVICE, IMAGE READING APPARATUS INCLUDING THE SHEET FEEDING DEVICE, AND IMAGE FORMING APPARATUS

(71) Applicant: CANON KABUSHIKI KAISHA, Tokyo (JP)

(72) Inventor: Takayuki Suga, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/919,547

(22) Filed: Jul. 2, 2020

(65) Prior Publication Data

US 2021/0009372 A1 Jan. 14, 2021

(30) Foreign Application Priority Data

Jul. 9, 2019 (JP) ..... JP2019-127770

(51) Int. Cl.
*B65H 7/18* (2006.01)
*B65H 7/02* (2006.01)
*B65H 3/06* (2006.01)

(52) U.S. Cl.
CPC ..... *B65H 7/18* (2013.01); *B65H 3/0607* (2013.01); *B65H 7/02* (2013.01)

(58) Field of Classification Search
CPC ..... B65H 7/18; B65H 3/0607; B65H 3/0669; B65H 2513/511; B65H 2513/54
See application file for complete search history.

(56) References Cited

U.S. PATENT DOCUMENTS 5,678,127 A 10/1997 Suga
6,059,285 A 5/2000 Suga et al.
6,260,840 B1 7/2001 Suga et al.
6,378,858 B1 4/2002 Suga
6,952,556 B2 10/2005 Endo et al.
8,038,140 B2 * 10/2011 Kimura ..... B65H 3/0684 271/10.03
2005/0067757 A1 3/2005 Suga et al.

FOREIGN PATENT DOCUMENTS

JP 55-101960 * 8/1980
JP 2001-139169 A 5/2001
JP 2010-202359 A 9/2010

OTHER PUBLICATIONS

Machine translation of JP 55-101960. (Year: 1980).*

* cited by examiner

*Primary Examiner* — Thomas A Morrison
(74) *Attorney, Agent, or Firm* — Venable LLP

(57) ABSTRACT

A sheet feeding device includes a stacking portion, a feeding portion, a contact and separation mechanism, a separation conveying portion, a detecting portion, a size acquiring portion, and a controller. In a first mode, in a case that the detecting portion detects passing of a trailing end of the current sheet after the separating operation, the controller causes the contact and separation mechanism to start a contact operation in which the feeding portion is contacted to a sheet stacked on the stacking portion in order to feed a subsequent sheet. In a second mode, before the detecting portion detects passing of a trailing end of the current sheet after the separating operation, the controller causes the contact and separation mechanism to start, on the basis of a distance in which the current sheet is fed by the separation conveying portion, the contact operation to feed the subsequent sheet.

14 Claims, 10 Drawing Sheets

(a)

(b)

SHEET FEEDING DEVICE, IMAGE READING APPARATUS INCLUDING THE SHEET FEEDING DEVICE, AND IMAGE FORMING APPARATUS

FIELD OF THE INVENTION AND RELATED ART

An image reading apparatus and an image forming apparatus such as a copying machine includes an original feeding device (automatic document feeder (ADF)) for reading image information while automatically feeding sheets which are originals, one by one. The ADF is required to stably feed the sheet without causing abnormal feeding (conveying) such as double (multi) feeding, crease of the sheet, oblique movement, and paper jam and to improve distance (the number of sheets fed (conveyed) per unit time).

In Japanese Laid-Open Patent Application (JP-A) 2001-139169, an ADF of which an original feeding speed is slowed when an original size is not less than a specific size has been disclosed. By slowing original feeding speed, oblique movement of the original is suppressed. Further, in JP-A 2010-202359, an ADF starting feeding of a subsequent sheet in the case where a plurality of sensors are provided in the neighborhood of a separation nip where separation of the sheet is carried out and a trailing end of a current original (sheet) is detected by either one of the sensors has been disclosed. By this ADF, productivity is improved while avoiding collision between the trailing end of the current original and a leading end of a subsequent original.

Incidentally, in a constitution of JP-A 2010-202359, on the basis of detection of passing of the trailing end of the current original by either one of the plurality of sensors, the subsequent original is conveyed after a pick-up roller provided upstream of the separation nip is lowered. By this method, an interval between the current original and the subsequent original has been increased depending on a time from passing of the trailing end of the current original through the separation nip until the pick-up roller lands on the subsequent original. Therefore, it would be considered that the lowering of the pick-up roller is started at earlier timing. However, in the case where it is difficult to estimate a length of an original such as a receipt or an acknowledgement, there was a liability that the pick-up roller contacts the current original which has not yet passed through the separation nip and thus causes double feeding of the originals or paper jam.

SUMMARY OF THE INVENTION

According to an aspect of the present invention, there is provided a sheet feeding device comprising: a stacking portion configured to stack a sheet; a feeding portion configured to feed the sheet stacked on the stacking portion in a feeding direction in contact with an upper surface of the sheet; a contact and separation mechanism configured to move the feeding portion toward and away from the sheet stacked on the stacking portion; a separation conveying portion configured to convey the sheet fed by the feeding portion while separating the sheet one by one in a separating portion positioned downstream of the feeding portion with respect to the feeding direction; a detecting portion configured to detect the sheet on a side downstream of the separating portion with respect to the feeding direction; a size acquiring portion configured to acquire information on a size of the sheet stacked on the stacking portion; and a controller configured to execute a separating operation in which after the controller causes the feeding portion to start feeding of a current sheet in a state in which the feeding portion contacts the current sheet stacked on the stacking portion, the controller causes the contact and separation mechanism to move the feeding portion away from the sheet stacked on the stacking portion, wherein on the basis of the information acquired by the size acquiring portion, the controller executes either one of operations in a plurality of modes including an operation in a first mode and an operation in a second mode, wherein in the first mode, in a case that the detecting portion detects passing of the trailing end of the current sheet after execution of the separating operation, the controller causes the contact and separation mechanism to start a contact operation in which the feeding portion is contacted to the sheet stacked on the stacking portion by the contact and separation mechanism to feed a subsequent sheet, and wherein in the second mode, before the detecting portion detects the passing of the trailing end of the current sheet after the execution of the separating operation, the controller causes the contact and separation mechanism to start, on the basis of a distance in which the current sheet is fed by the separation conveying portion, the contact operation to feed the subsequent sheet.

By this, it becomes possible to not only stabilize a feeding (conveying) operation but also improve productivity.

Further features of the present invention will become apparent from the following description of exemplary embodiments with reference to the attached drawings.

Figure 3:
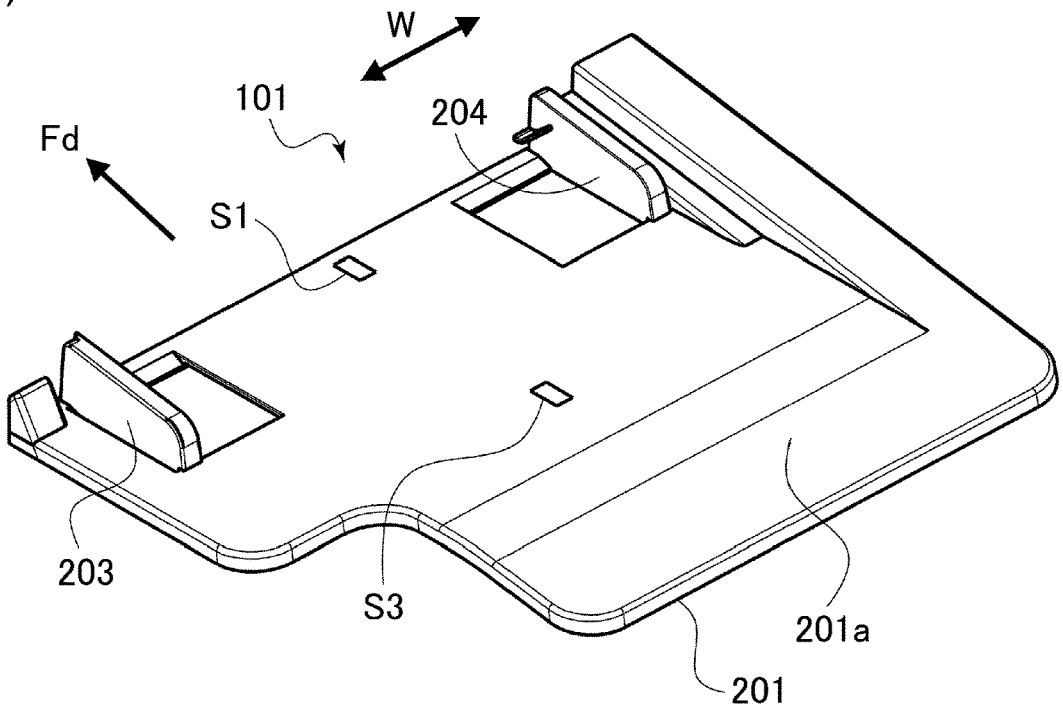
Figure 3:
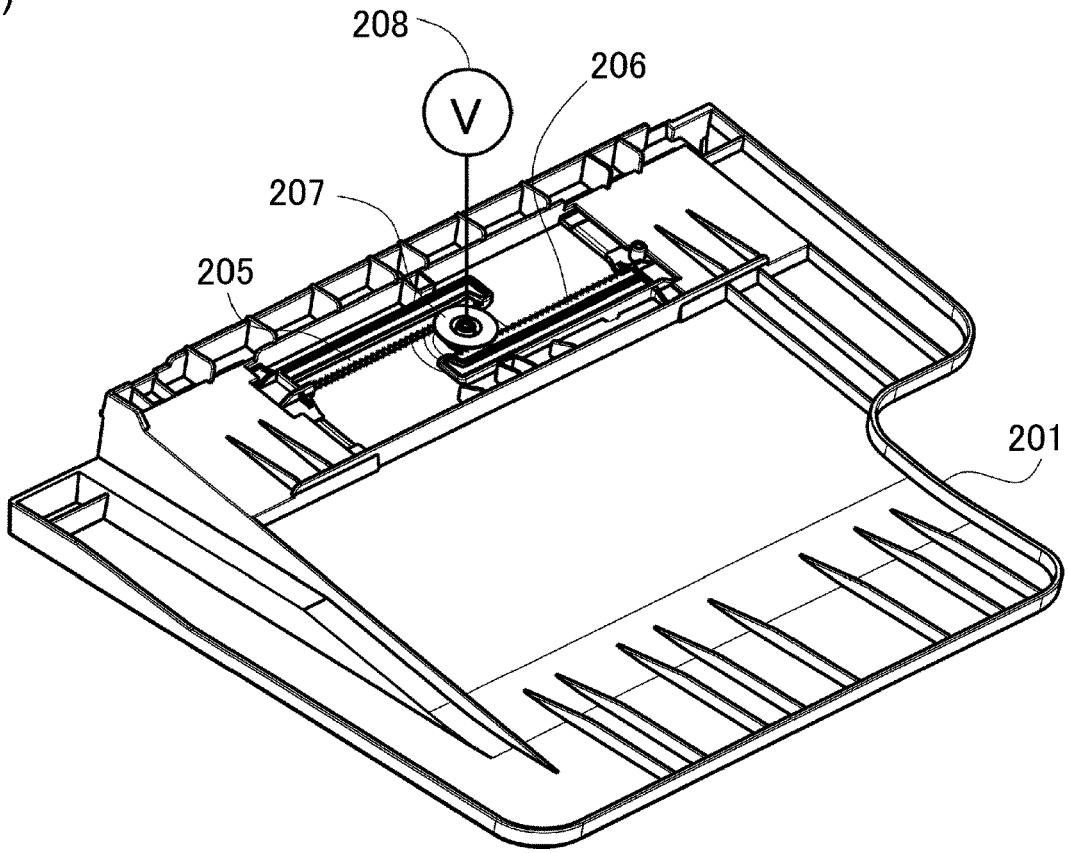

Parts (a) and (b) of FIG. 3 are perspective views of an original tray as seen from a front (top) side and a back (bottom) side, respectively.

Figure 4:
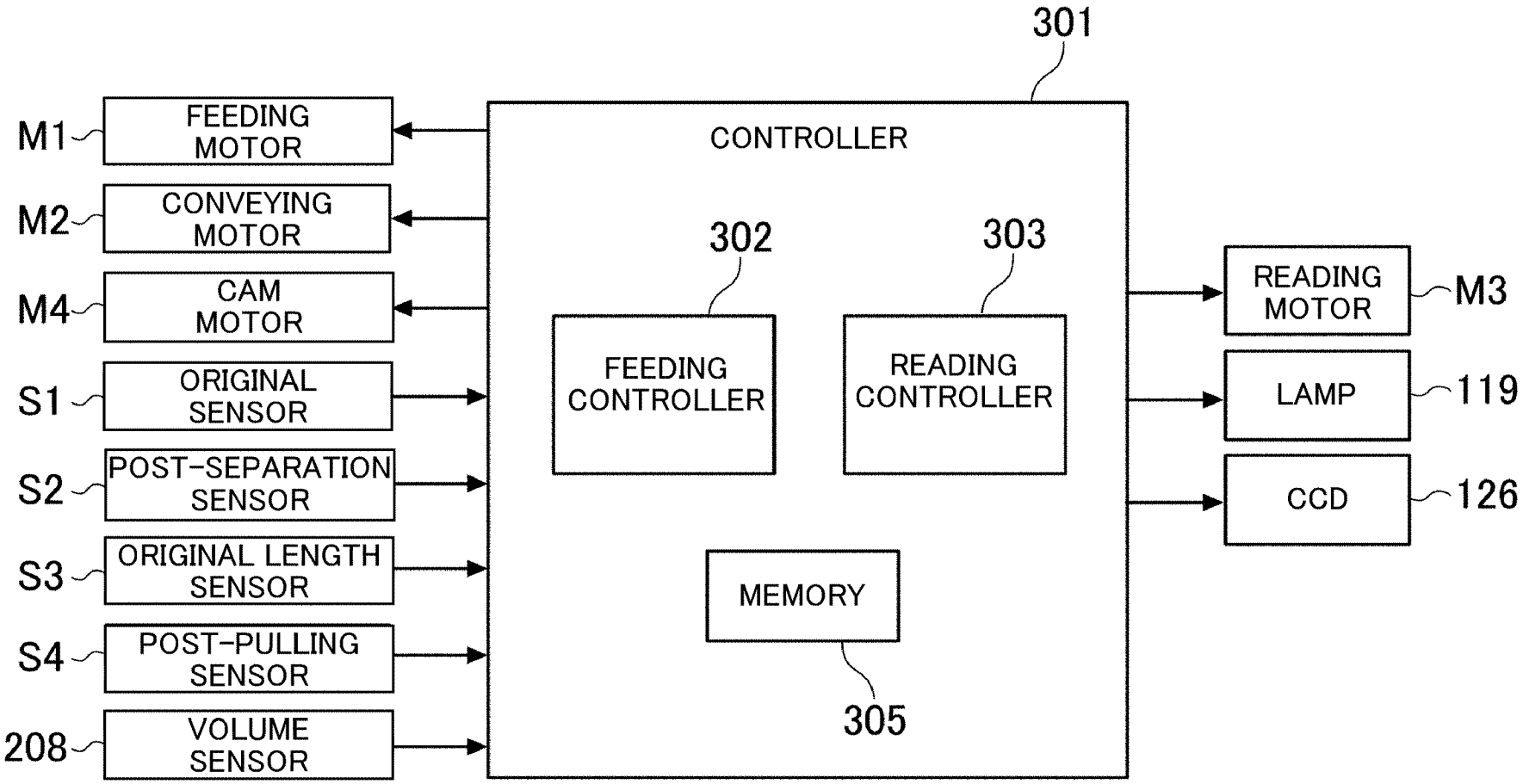

FIG. 4 is a block diagram showing a constitution of the image reading apparatus according to the embodiment.

Figure 5:
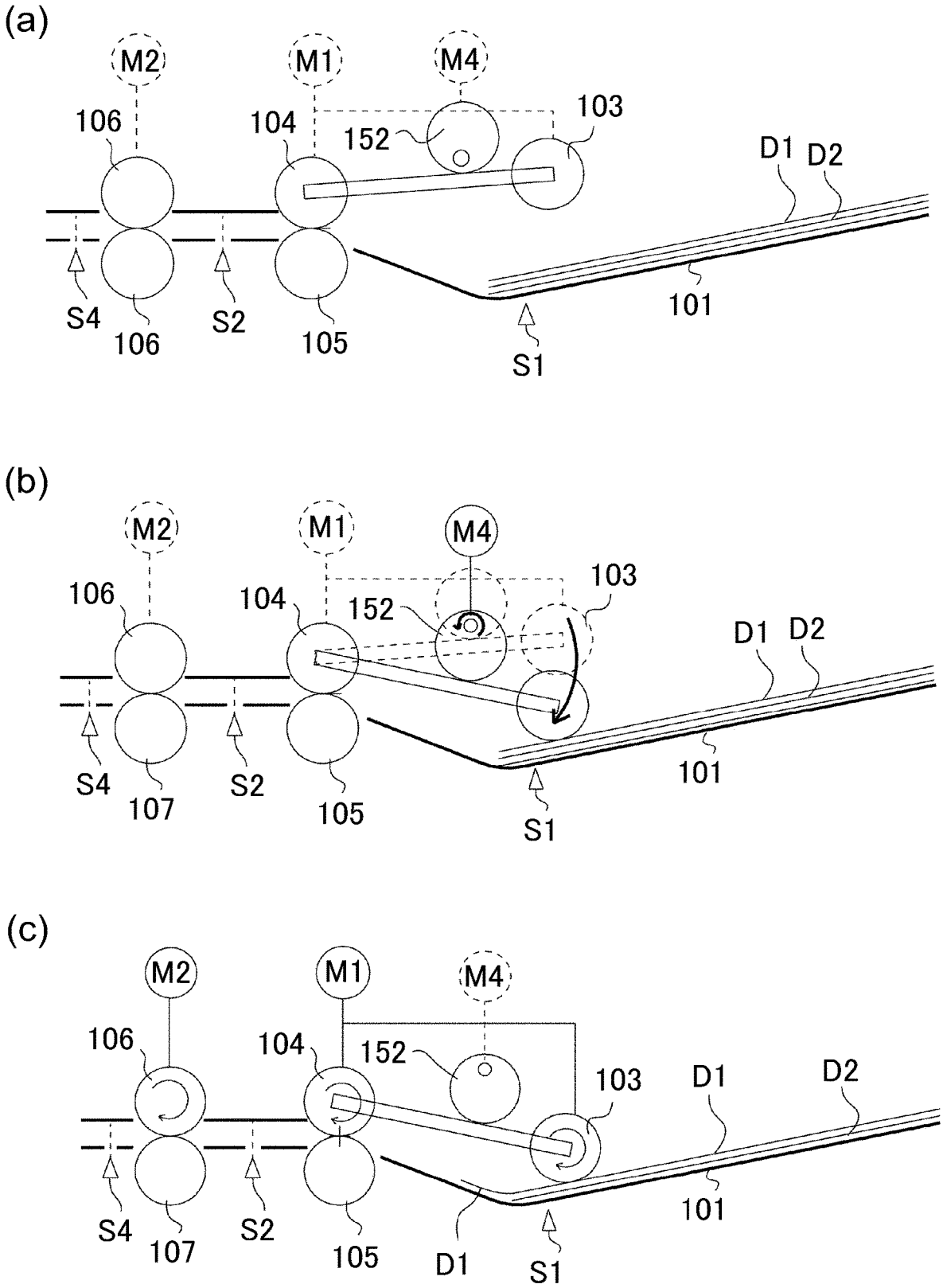

Parts (a) to (c) of FIG. 5 are schematic views for illustrating a feeding (conveying) operation of a regular sheet by an ADF according to the embodiment.

Figure 6:
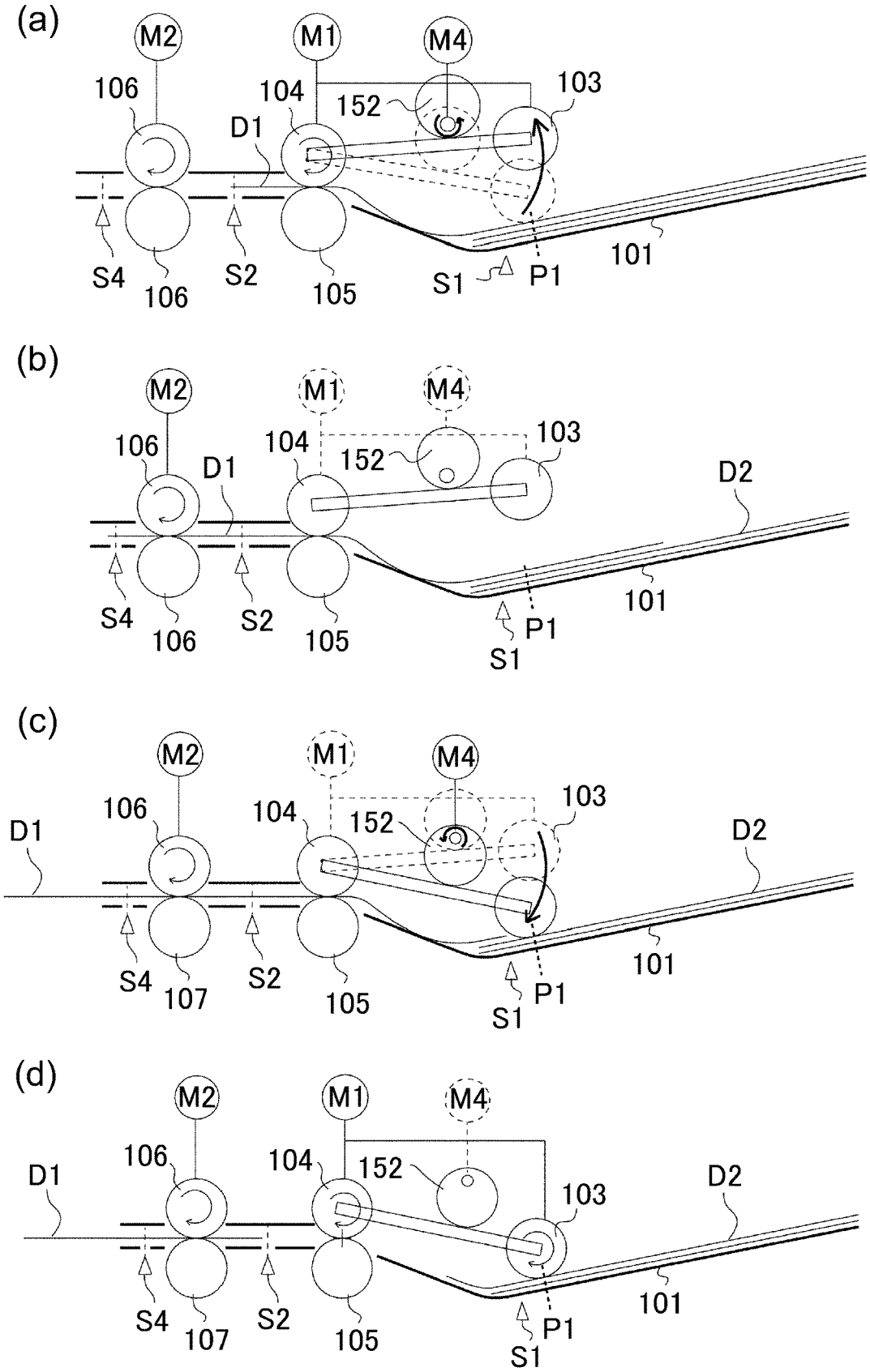

Parts (a) to (d) of FIG. 6 are schematic views for illustrating the feeding operation of the regular sheet by the ADF according to the embodiment.

Figure 7:
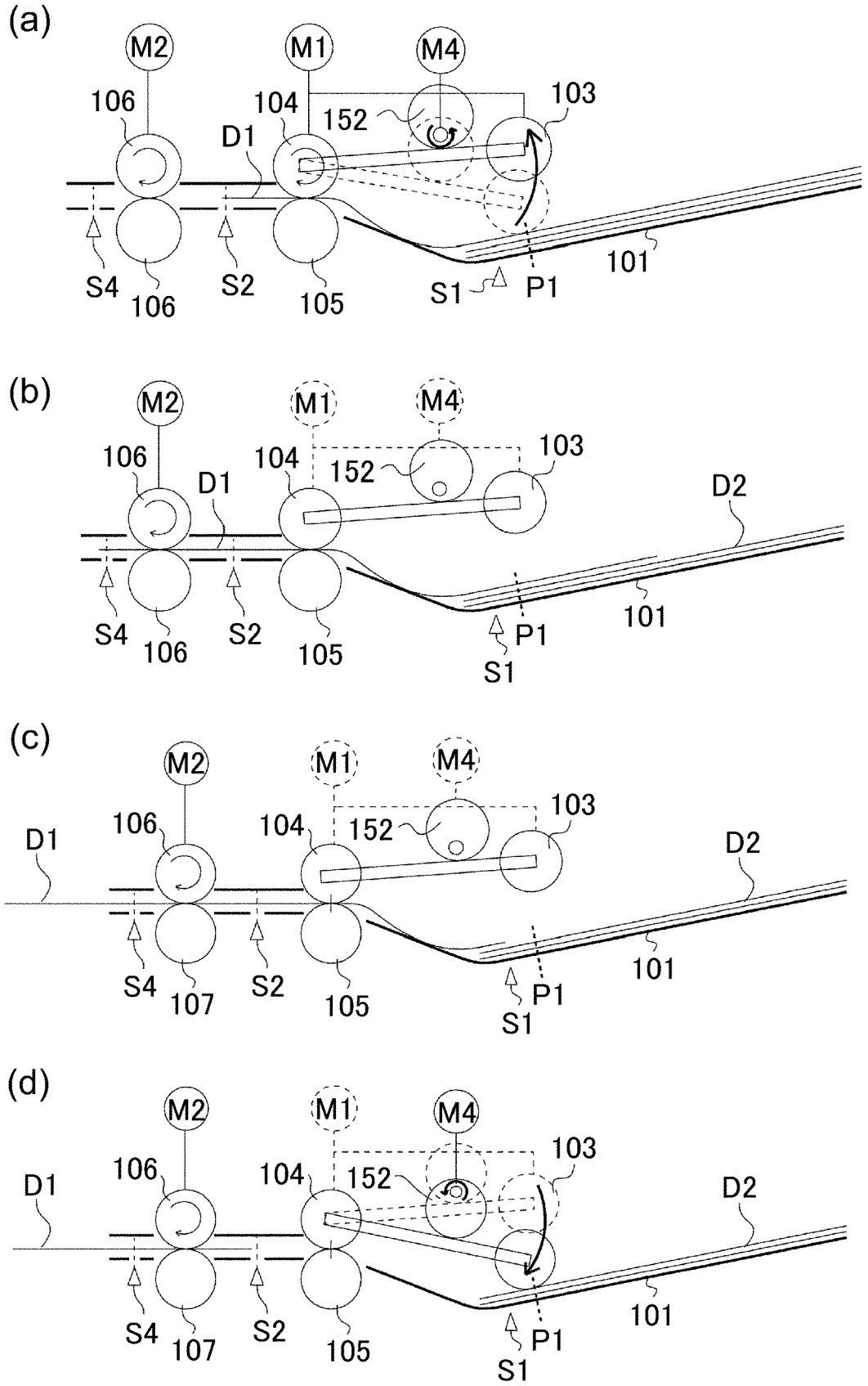

Parts (a) to (d) of FIG. 7 are schematic views for illustrating a feeding operation of a narrow sheet by the ADF according to the embodiment.

Figure 8:
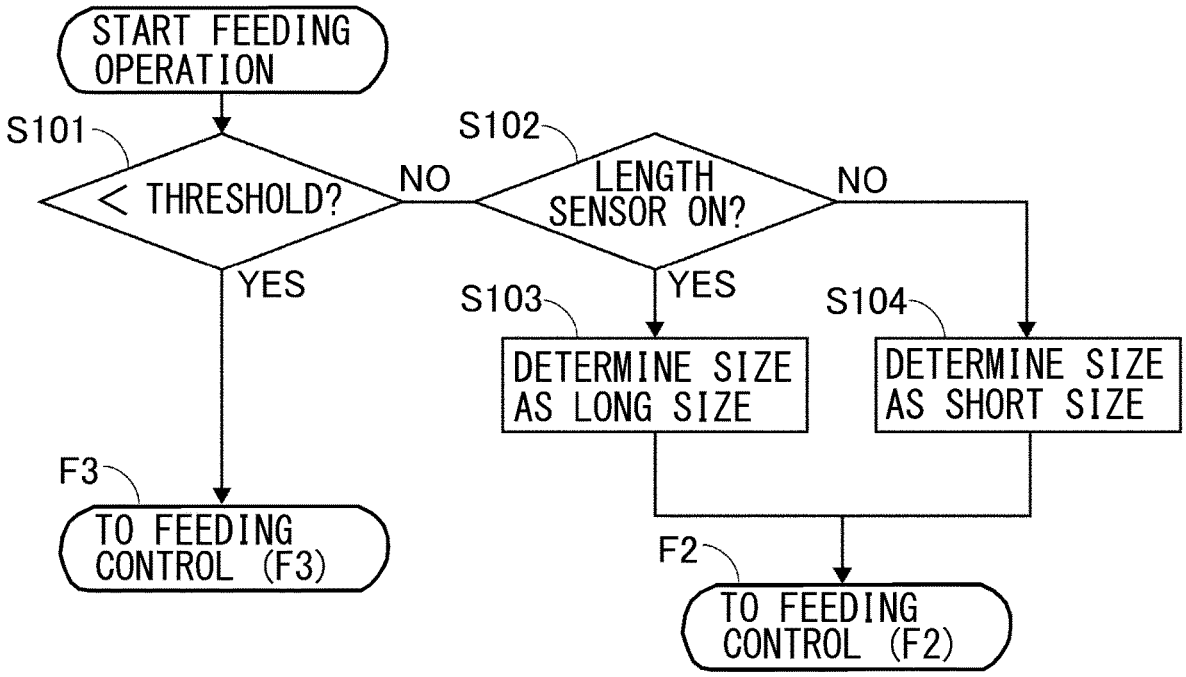

FIG. 8 is a flowchart showing a control method of the ADF according to the embodiment.

Figure 9:
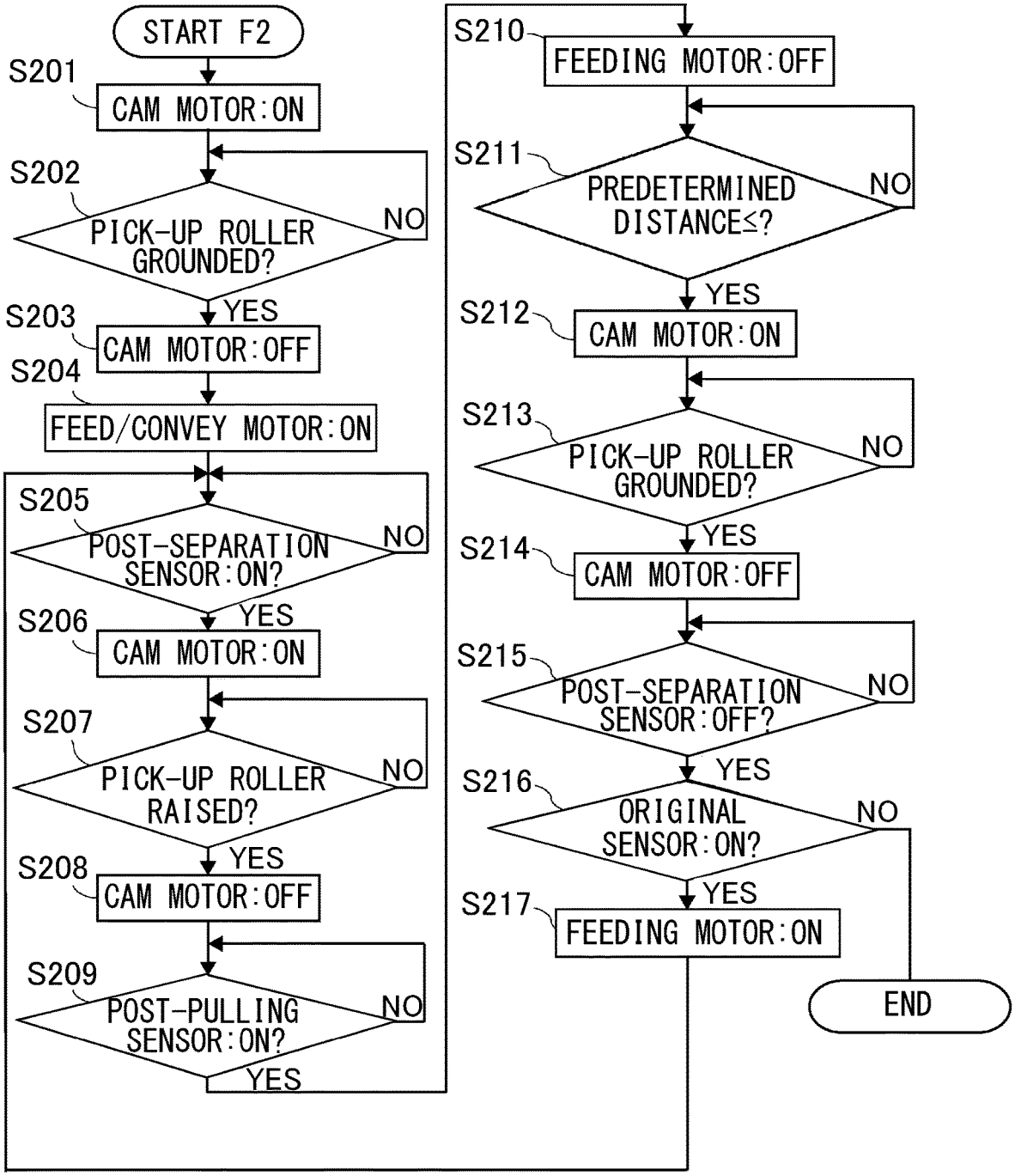

FIG. 9 is a flowchart showing the control method of the ADF according to the embodiment (the case of the regular sheet).

Figure 10:
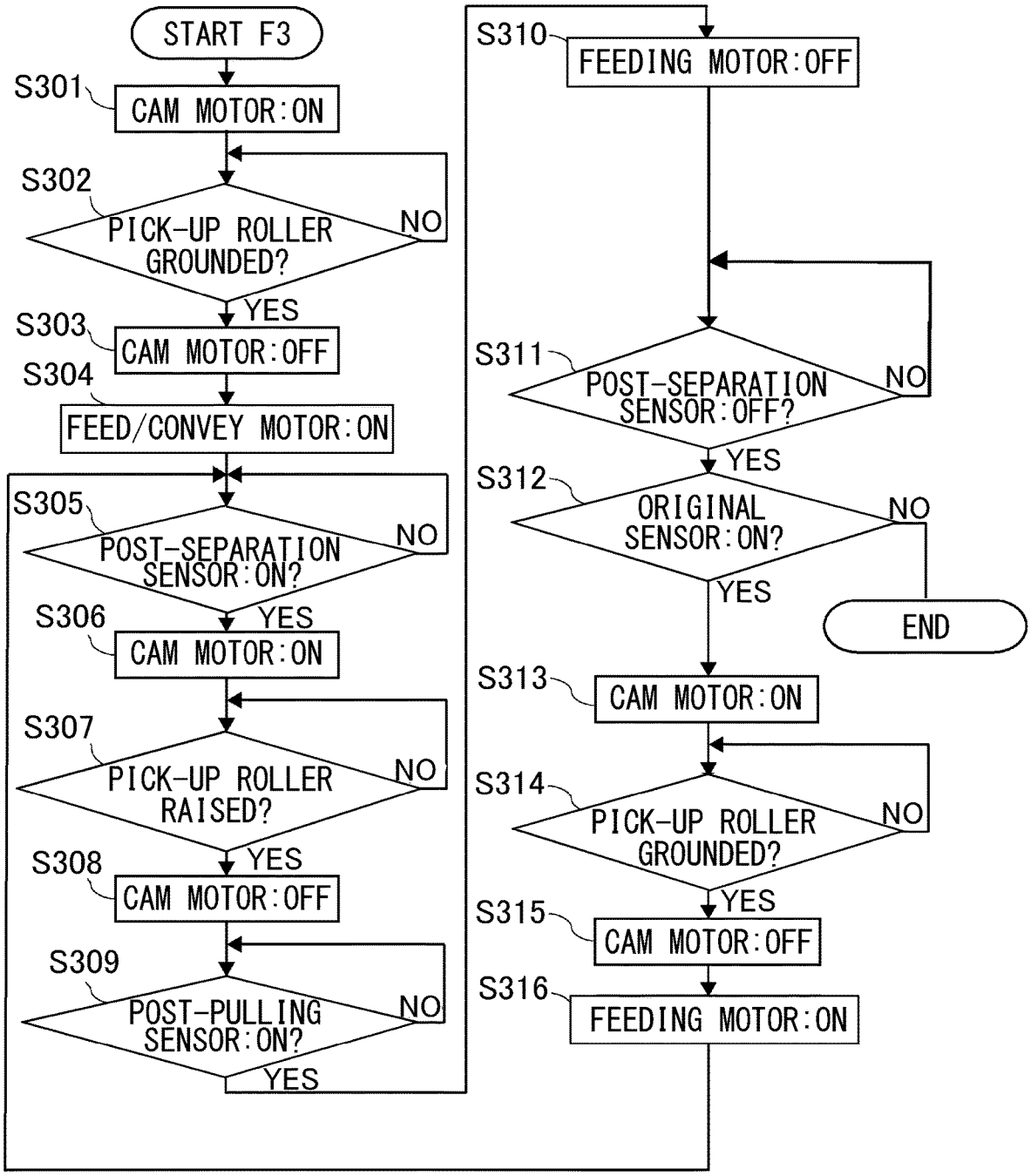

FIG. 10 is a flowchart showing the control method of the ADF according to the embodiment (the case of the narrow sheet).

DESCRIPTION OF EMBODIMENTS

In the following, an embodiment for carrying out the present invention will be described with reference to the drawings.

Image Forming Apparatus

Figure 1:
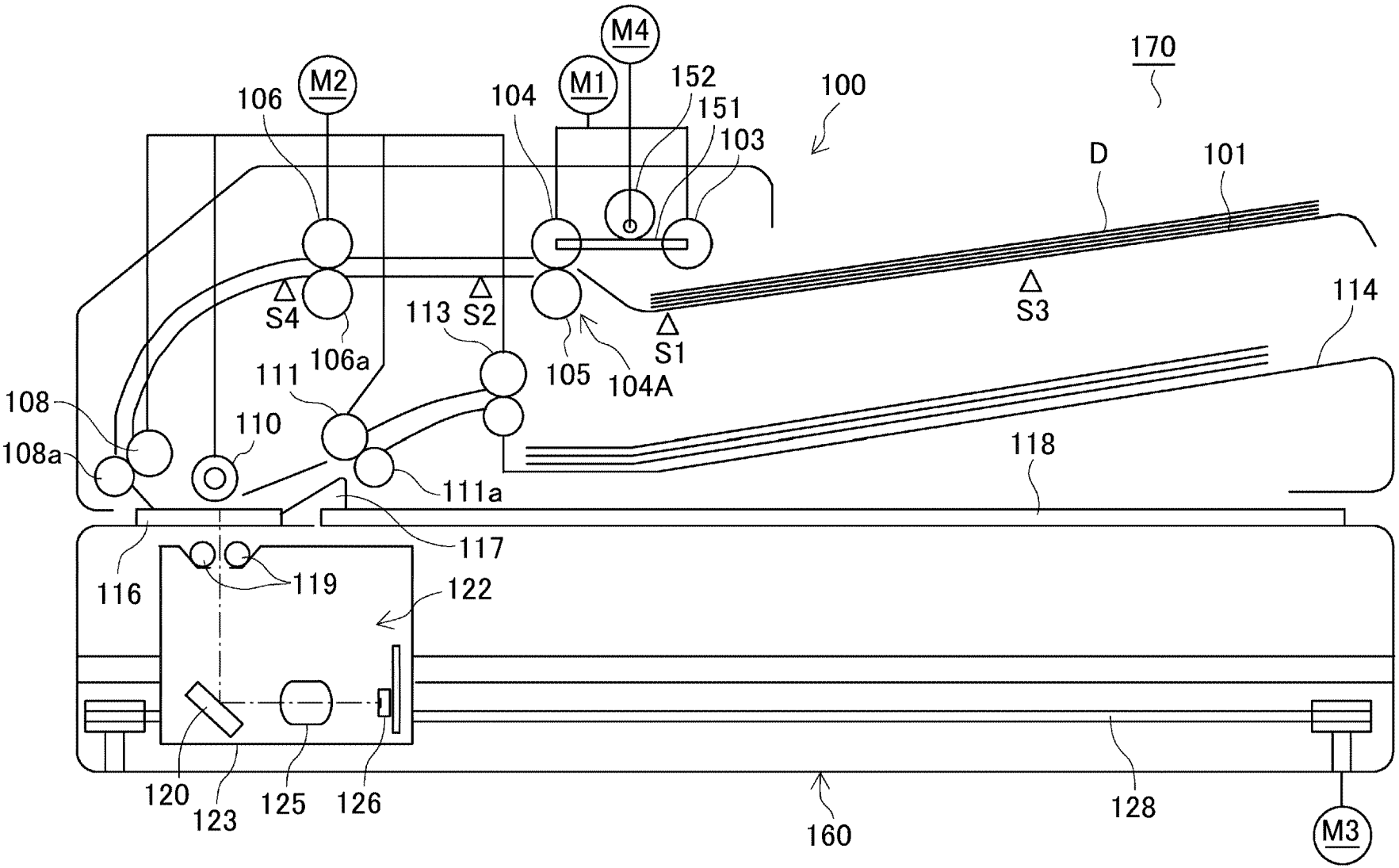
FIG. 1 is a schematic view of an image reading apparatus according to an embodiment.
Figure 2:
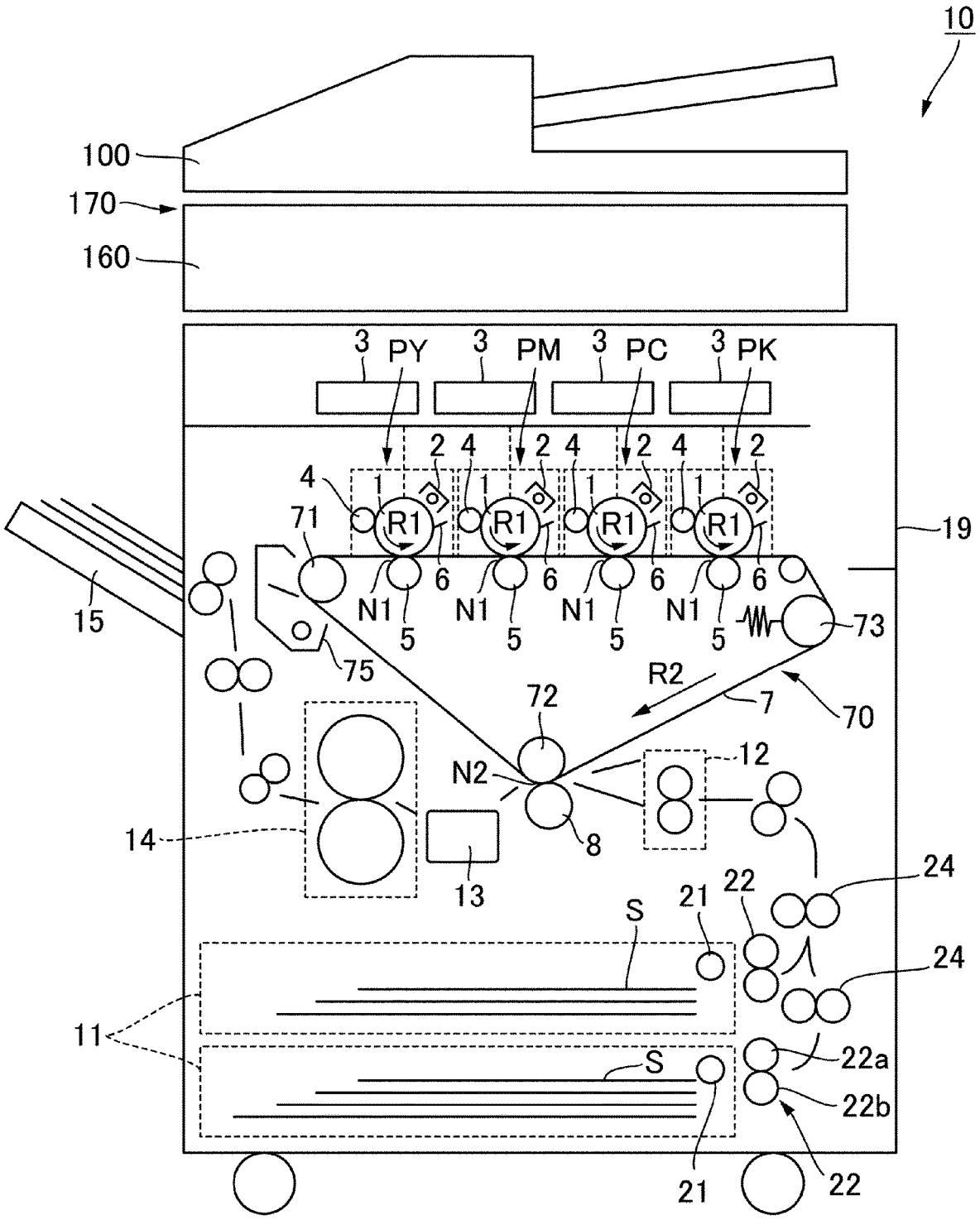
FIG. 2 is a schematic view of an image forming apparatus including the image reading apparatus according to the embodiment.

FIG. 1 is a schematic view of an ADF 100 according to an embodiment of the present invention and an image reading apparatus 170 including this ADF 100. FIG. 2 is a schematic view of an image forming apparatus 10 in which the image reading apparatus 170 is mounted. First, a general structure of the image forming apparatus 10 will be described.

The image forming apparatus 10 of this embodiment is a copying machine of a tandem type and an intermediary transfer type in which a full-color image is outputted on a recording material by an electrophotographic process. The image forming apparatus 10 includes image forming stations for forming toner images of yellow (Y), magenta (M), cyan (C) and black (K), respectively, an intermediary transfer unit 70, and a fixing device 14.

In the case where the image forming apparatus 10 performs an image forming operation, the respective image forming stations PY to PK form a toner image of a single color by the electrophotographic process. That is, a photosensitive drum 1 as an image bearing member is rotationally driven in a predetermined rotational direction R1, and a charger 2 electrically charges a surface of the photosensitive drum 1 uniformly. The surface of the photosensitive drum 1 is scanned by an exposure device 3 with laser light modulated on the basis of data color-separated from image data for each of color components, so that the exposure device 3 writes (forms) an electrostatic latent image on the drum surface. This latent image is developed with a developer supplied from a developing device and is visualized as a toner image.

The intermediary transfer unit 70 is constituted by extending an intermediary transfer belt 7 around a driving roller 71, an inner secondary transfer roller 72 and a tension roller 73. When the image forming operation is started, the intermediary transfer belt 7 is rotationally driven in a rotational direction R2 in which the intermediary transfer belt 7 is cooperation with the photosensitive drums 1 by the driving roller 71. Toner images which are formed in the image forming stations PY to PK and which are borne on the photosensitive drums 1 are primary-transferred from the photosensitive drums 1 onto the intermediary transfer belt 7 by a bias electric field formed by primary transfer rollers 5. At that time, the toner images of the respective colors are multiple-transferred so as to be superposed on each other, so that a full-color toner image is formed on a surface of the intermediary transfer belt 7. Further, a deposited matter such as transfer residual toner remaining on each of the photosensitive drums 1 without being transferred onto the intermediary transfer belt 7 is removed by a drum cleaner of an associated one of the image forming stations.

At a position opposing the inner secondary transfer roller 72 through the intermediary transfer belt 7, a secondary transfer roller 8 is provided, so that a secondary transfer portion N2 is formed as a nip between the secondary transfer roller 8 and the intermediary transfer belt 7. The toner image carried on the intermediary transfer belt 7 is secondary-transferred in the secondary transfer portion N2 onto a recording material S fed (conveyed) one by one toward the secondary transfer portion N2 as described later. A deposited matter, such as transfer residual toner remaining on the intermediary transfer belt 7 without being transferred onto the recording material S is removed by a belt cleaner 75.

The recording material S on which the toner image is transferred into the secondary transfer portion N2 is sent to the fixing device 14 through a conveying belt 13. The fixing device 14 includes a rotatable member pair comprising a belt and/or a roller for nipping and conveying the recording material S and includes a heat source such as a halogen lamp for heating the toner image on the recording material S, and heats and presses the toner image while conveying the recording material S by the rotatable member pair. By this, the toner is method and then is fixed, so that it is possible to obtain an image fixed on the recording material S.

In parallel to such a process, a conveying (feeding) operation for feeding and conveying the recording material S toward the secondary transfer portion N2 is performed. The image forming apparatus 10 includes feeding cassettes 11 for accommodating the recording materials S at a lower portion of an apparatus main assembly 19, and the recording materials S are fed one by one from either one of the feeding cassettes 11. As the recording materials S, it is possible to use various sheets different in size and material, including papers such as plain paper and thick paper, a plastic film, a cloth, a sheet material subjected to surface treatment, such as coated paper, a sheet material having a special shape, such as an envelope or index paper.

The recording materials S stacked on the feeding cassette 11 is fed from the feeding cassette 11 by a feeding roller 21 and reaches a separation roller pair 22. The separating roller pair 22 includes a conveying roller 22*a* for continuously conveying the recording material S and a separation roller 22*b* contacting the conveying roller 22*a*. The separation roller 22*b* is, for example, connected to a shaft fixed to the apparatus main assembly 19 of the image forming apparatus 10 through a torque limiter, so that a frictional force is imparted to the recording material S passing through a separation nip between the conveying roller 22*a* and the separation roller 22*b*. By this, when a plurality of recording materials S enter the separation nip, only an uppermost recording material contacting the conveying roller 22*a* is conveyed, and another recording material (other recording materials) is prevented by the separation roller 22*b* from being conveyed.

The recording material S sent from the separation roller 22*b* is conveyed toward a registration roller pair 12 by a drawing roller pair 24. The registration roller pair 12 not only corrects oblique movement of the recording material S but also sends the recording material S toward the secondary transfer portion N2 at timing synchronized with a start of formation of the toner images by the image forming stations PY to PK. The recording material S on which the image is formed passes through the secondary transfer portion N2 and the fixing device 14 and then is conveyed along a discharging passage, and is discharged onto a discharge tray 15 provided on a side of the apparatus main assembly 19.

In the above-described explanation, the image forming stations PY to PK, the intermediary transfer unit 70 and the fixing device 14 which constitute an electrophotographic mechanism of an intermediary transfer type are examples of an image forming portion. In place of the above-described constitution (mechanism), for example, an electrophotographic mechanism of a direct transfer type in which the toner image formed on a photosensitive member is directly transferred onto a recording material may also be used. Further, the image forming portion is not limited to the image forming portion of the electrophotographic type, but for example, a printing unit of an ink jet type and an offset printing mechanism may also be used as the image forming portion.

Image Reading Apparatus

Next, the image reading apparatus 170 according to the present invention will be described. The image reading apparatus 170 is roughly constituted by the ADF 100 and a main body portion 160. The main body portion 160 is fixed to an upper portion of the apparatus main assembly 19 (FIG. 2) of the image forming apparatus 10, and the ADF 100 is supported by the main body portion 160 so as to be openable and closable.

As shown in FIG. 1, the ADF 100 includes an original tray 101, a feeding roller 103, a conveying roller 104, a separation roller 105, a discharging roller 113, and a discharge tray 114. Further, the ADF 100 includes a plurality of roller members (a drawing roller 106, a retard roller 108, a platen guide roller 110, a lead discharging roller 111) provided along an original conveying passage from the conveying roller 104 to the discharging roller 113.

The original tray 101 is a stacking portion in this embodiment in which an original D which is a sheet to be fed. The original tray 101 is provided with an original presence/absence sensor S1 for detecting the presence or absence of the original set in a feedable position. Incidentally, an original length sensor S3 similarly provided to the original tray 101 will be described later.

The feeding roller 103 which is a feeding portion in this embodiment is disposed above the original tray 101 and upstream of a detecting position of the original presence/absence sensor S1 with respect to an original feeding direction. The feeding roller 103 functions as a pick-up roller for feeding the original from the original tray 101. The feeding roller 103 is constituted so as to be capable of being raised and lowered relative to the original tray 101 by an arm 151 and is rotationally driven by a feeding motor M1 as a first driving source.

The arm 151 not only rotatably supports the feeding roller 103 but also swings upward and downward by a cam 152 driven by a cam motor M4 as a secondary driving source. The feeding roller 103 is retracted to an upper position which is a home position in a stand-by state and is configured so as not to prevent a setting operation of the original D, but when the feeding roller 103 feeds the original D, the cam 152 is operated by rotation of the cam motor M4, so that the feeding roller 103 is lowered to a position where the feeding roller 103 contacts an upper surface of the original D. The cam 152 constitutes a contact and separation mechanism in this embodiment for moving the feeding portion toward and away from the sheet on the stacking portion. Incidentally, control relating to a contact operation and a separating operation of the feeding roller 103 described below is also applicable to a constitution in which a raising and lowering plate provided to the original tray 101 is raised and lowered relative to the feeding roller 103 by a cam mechanism or the like.

The conveying roller 104 and the separation roller 105 constitute a separation conveying roller pair 104A which is a separation conveying portion in this embodiment. The conveying roller 104 and the separation roller 105 form a separation nip as a separation portion on a side downstream of the feeding roller 103 with respect to the feeding direction of the original D.

The separation roller 105 is formed with a rubber material or the like slightly smaller in friction than the conveying roller 104 and feeds (conveys) the original D, fed by the feeding roller 103, while separating the original D one by one in the separation nip in cooperation with the conveying roller 104. That is, the separation roller 105 is, for example, connected to a shaft fixed to a frame of the ADF 100 through a torque limiter and imparts a frictional force to the original D passing through the separation nip in a direction opposite to the feeding direction. By this, when a plurality of sheets of the originals D enter the separation nip, only an uppermost original contacting the conveying roller 104 is conveyed, and other originals are prevented from being conveyed by the separation roller 105. However, the separation roller 105 is an example of a separating member for preventing double feeding by the frictional force, so that a pad-shaped friction member contacting the conveying roller 104 and a roller member to which a driving force (retard drive) with respect to the direction opposite to the feeding direction is inputted through the torque limiter may also be used.

On a side downstream of the separation nip with respect to the original feeding direction by the conveying roller 104, a post-separation sensor S2 for detecting passing of a leading end (downstream end with respect to the feeding direction) or a trailing end (upstream end with respect to the feeding direction) of the original through the separation nip is provided. The post-separation sensor S2 is a detecting portion in this embodiment for detecting the sheet in a detecting position on a side downstream of the separation portion.

On a side further downstream of the post-separation sensor S2, the drawing roller 106 as a downstream conveying portion is disposed. The drawing roller 106 is driven by a conveying motor M2 as a third driving source and nips and conveys the original D received from the separation conveying roller pair 104A, in cooperation with a drawing follower roller 106*a*. On a side downstream of the drawing roller 106, a post-drawing sensor S4 for detecting passing of the leading end or the trailing end of the original through the drawing roller 106 is provided. The post-drawing sensor S4 is a downstream detecting portion in this embodiment.

The retard roller 108 is driven by the conveying motor M2 and nips the original D received from the drawing roller 106, in cooperation with a lead follower roller 108*a* and conveys the original D toward a moving reading glass 116. The moving reading glass 116 is a transparent member provided on the main body portion 160 of the image reading apparatus 170. A scanning unit 122 described later scans the surface of the original D through the moving reading glass 116. The platen guide roller 110 is disposed at a position opposing the moving reading glass 116 and restricts a passing position of the original D with respect to a direction of a depth of field of the scanning unit 122.

The lead discharging roller 111 is disposed downstream of the moving reading glass 116 and the platen guide roller 110. The lead discharging roller 111 is driven by the conveying motor M2 and nips and conveys the original D, passed through the moving reading glass 116, toward the discharging roller 113 in cooperation with a lead discharging follower roller 111*a*. Incidentally, the main body portion 160 of the image reading apparatus 170 is provided with a jump stand 117 for guiding the original D, passed through the moving reading glass 116 toward the lead discharging roller 111 by raising the original D.

The discharging roller 113 discharges the original D, received from the lead discharging roller 111, to an outside space of the ADF 100 and stacks the original D on the discharge tray 114.

The main body portion 160 of the image reading apparatus 170 includes the scanning unit 122 which is a reading portion in this embodiment. The scanning unit 122 in an image sensor of a CCD type in which lamps 119 for irradiating a reading surface of the original D with light and a CCD line sensor 126 which is an image pick-up element which subjects reflected light from the original D to photoelectric conversion. Further, the scanning unit 122 includes a mirror 120 for guiding the reflected light from the original D to the CCD line sensor 126 and a lens 125 for focusing light, travelling from the mirror 120 toward the CCD line sensor 126, on an imaging plane of the line sensor.

The scanning unit 122 is mounted on a carriage 123, and the carriage 123 is connected to a timing belt 128 driven by a reading motor M3. Further, the main body portion 160 is provided with an original supporting platen glass 118 capable of placing an original thereon separately from the original D fed by the ADF 100. The scanning unit 122 is movable below the moving reading glass 116 and the original supporting platen glass 118 in a left-right direction in the figure (FIG. 1) by a driving force of the reading motor M3.

In the case where a moving reading operation for reading image information from the original by using the ADF 100 is performed, first, the feeding roller 103 lowers from the home position and contacts the uppermost original D on the original tray 101, and then feeds the original D in the feeding direction (toward the left-hand side in the figure). This original D is separated from other originals D by the separation conveying roller pair 104A and thereafter reaches the moving reading glass 116 through the drawing roller 106 and the retard roller 108. The scanning unit 122 of the main body portion 160 optically scans the original D, passing through a reading position on the moving reading glass 116, in a state in which the scanning unit 122 is put in the position shown in FIG. 1. That is, the original D is irradiated with the light from the lamp 119, and reflected and scattered light from the original D is formed as an image on the imaging plane of the CCD line sensor 126 through the mirror 120 and the lens 125. The CCD line sensor 126 subjects the imaged reflected light to the photoelectric conversion and outputs an electric signal depending on an incident light quantity. The original D of which image is read by the scanning unit 122 is discharged onto the discharge tray 114 through the lead discharging roller 111 and the discharging roller 113.

On the other hand, in the case where a fixing reading operation for reading image information from an original placed at rest on the original supporting platen glass 118 is performed, a user sets the original on the original supporting platen glass 118 in a state in which the ADF 100 is pushed upward and thus is opened, and then the user presses down the ADF 100. In this state, when a start instruction of the reading operation is provided, the carriage 123 is moved in a sub-scan direction (left-right direction in the figure) by the timing belt 128, so that the original is optically scanned by the scanning unit 122. By this, an optical image on a static original is converted into an electric signed by the action of photoelectric conversion by the CCD line sensor 126.

Next, a structure of the original tray 101 will be described. Part (a) of FIG. 3 is a perspective view of the original tray 101 as seen from a front side (from above), and part (b) of FIG. 3 is a perspective view of the original tray 101 as seen from a back side.

As shown in part (a) of FIG. 3, the original tray 101 includes a tray plate 201 constituting a tray body and side restricting plates 203 and 204 as side end restricting. The side restricting plates 203 and 204 are a pair of restricting members movable in a widthwise direction W of the original perpendicular to a feeding direction Fd of the original, and restrict a position of the original with respect to the widthwise direction W by contact thereof with end portions (side ends) of the original with respect to the widthwise direction W.

The side restricting plates 203 and 204 are connected to each other through racks 205 and 206 and a pinion 207. By this, the pair of side restricting plates 203 and 204 slides (moves) while maintaining a symmetrically positional relationship therebetween with respect to a reference position (conveyance center) which is a center position of the original on the original tray 101 with respect to the widthwise direction W.

The pinion 207 is provided with a volume sensor 208 as a sheet width detecting portion in this embodiment. The volume sensor 208 is a variable resistor constituted so as to change in output voltage depending on an angle of rotation of the pinion 207, i.e., positions of the side restricting plates 203 and 204 with respect to the widthwise direction W. A controller of the image reading apparatus 170 is capable of grasping a sheet width (original size with respect to the widthwise direction W) of the original set on the original tray 101 at this time by making reference to output of the volume sensor 208.

Further, as shown in part (a) of FIG. 3, the original tray 101 is provided with the original length sensor S3 as a sheet length detecting portion in this embodiment. The original length sensor S3 is a sensor for detecting the presence or absence of the original at position apart from an original set position, on a downstream side on the original tray 101 with respect to the feeding direction Fd, toward an upstream side by a predetermined distance. In this embodiment, of regular size-sheets feedable by the ADF 100 (hereinafter, referred to as regular sheets), there are sheets with a plurality of sizes equal to each other in sheet width. The original length sensor S3 is used, in the case where an original size of the regular sheet cannot be determined only by a detection result of such a volume sensor 208, for discriminating a size of the original set on the original tray 101 at this time. That is, the volume sensor 208 and the original length sensor S3 function as a size acquiring portion for acquiring information on a size of the sheet to be fed by the sheet feeding device.

A detecting position of the original length sensor S3 may suitably be set at a position upstream of an end of a short-side length (210 mm) of an A4-size sheet with respect to the feeding direction Fd on the basis of the original set position and downstream of an end of a long-side length (364 mm) of a B4-size sheet with respect to the feeding direction Fd on the basis of the original set position. By disposing the original length sensor S3 at such a position, it is possible to discriminate whether the original set on the original tray 101 is the A4-size sheet set in a short-side feeding direction or an A3-size sheet set in a long-side feeding direction. Further, by the same arrangement, it is possible to discriminate whether the original set on the original tray 101 is a B5-size sheet set in a short-side feeding direction or a B4-size sheet set in the long-side feeding direction.

FIG. 4 is a block diagram showing a control constitution of the image reading apparatus 170 according to this embodiment. A controller 301 which is a control portion in this embodiment is a control circuit including at least one processor such as a CPU and including a memory 305. The processor of the controller 301 controls an original conveying operation by the ADF 100 and an image reading operation by the main body portion 160 by reading and executing a program stored in the memory 305. In the following, of the controller 301, a functional unit for controlling the original conveying operation by the ADF 100 is referred to as a "conveying controller 302", and a functional unit for controlling the image reading operation by the main body portion 160 is referred to as a "reading controller 303". The conveying controller 302 and the reading controller 303 may also be mounted as a functional module for a program executed by the CPU of the controller 301 or may also be mounted as an independent hardware such as ASIC on a circuit of the controller 301.

On the basis of output signals of the above-described various sensors (S1, S2, S3, S4, 208), the conveying controller 302 acquires pieces of information such as the presence or absence of the original, an original size, and an original position in a conveying passage. Further, the conveying controller 302 sends an instruction to driving circuits of the respective motors in accordance with flowcharts described later, and thus controls driving states of the feeding motor M1, the conveying motor M2 and the cam motor M4. The reading controller 303 executes the moving reading operation or the fixing reading operation by controlling the lamp 119, the CCD line sensor 126 and the reading motor M3, and thus reads image information from the original by the scanning unit 122.

In the memory 305, set values need to control the conveying controller 302 and the reading controller 303 (for example, a sheet width threshold in a mode switching (S101 of FIG. 8) in a feeding operation described later, a sheet width and a sheet length for each of the regular sizes) are stored. The memory 305 includes a non-volatile memory medium such a read-only memory (ROM) and a volatile memory medium such as random-access memory (RAM), and constitutes not only a storage place for the programs and data but also an operation space when the processor executes the programs. The memory 305 is an example of a non-transient memory medium storing the program for controlling the image forming apparatus.

In the following, a mode in the original conveying operation by the ADF 100 according to this embodiment will be described with reference to FIGS. 5 to 10 by being divided into the case where the original is the regular size and the case where the original is a narrow sheet narrower in sheet width than the regular size. Incidentally, respective steps of flowcharts of FIGS. 8 to 10 are carried out by the controller 301 (particularly the conveying controller 302) shown in FIG. 4.

Conveying Operation: Case of Regular Sheet

First, the conveying operation of the regular sheet will be described using FIGS. 5, 6, 8 and 9. FIGS. 5 and 6 show states in the conveying operation in the case where regular size-originals D1 and D2 are conveyed. Examples of the regular size are A4, A3, B5 and B4. The originals D1 and D2 are superposed two originals in a state in which the originals D1 and D2 are stacked on the original tray 101, and when the original D1 is a current sheet to be conveyed first, the original D2 corresponds to a subsequent sheet conveyed subsequently to the current sheet (original D1).

In the case where the regular size-original is conveyed, the user stacks the originals on the original tray 101 in advance before the user provides an instruction to execute the reading operation to the image reading apparatus 170 and then moves the side restricting plates 203 and 204 in alignment with side ends of the originals. The conveying controller 302 recognizes the sheet width of the originals from a value of an output voltage of the volume sensor 208 by making reference to correspondence between an output voltage and the sheet size of the original which are stored in the memory 305 in advance. Further, depending on whether or not the original length sensor S3 detects the original, the conveying controller 302 discriminates whether the original size is either one of the regular sizes.

When the instruction to execute the reading operation is provided to the image reading apparatus 170, the conveying controller 302 causes the ADF 100 to start a process for conveying the originals ("START" of FIG. 8). At this time, when the original is identified as the regular sheet by detection results of the volume sensor 208 and the original length sensor S3, a sequence (F2) of FIG. 9 which is conveying control (operation in a second mode in this embodiment) for the regular sheet is started.

In this embodiment, in the case where the sheet width of the original detected by the volume sensor 208 is not less than a preset threshold (S101: NO), the size of the original is treated as the regular size. Further, the conveying controller 302 discriminates that the size of the original is the regular size on the basis of the sheet width, the conveying controller 302 determines whether the size of the original is either one of the regular sizes on the basis of the detection result of the original length sensor S3 (S102 to S104). At this time, when the original length sensor S3 detects the original, a long size of the regular sizes (for example, B5 with short-side feeding orientation and B4 with long-side feeding orientation) having the same sheet width is employed, and when the original length sensor S3 does not detect the original, a short size of the regular sizes is employed. Then, by using a determined size information, the conveying controller 302 executes the conveying control for the regular sheet (F2).

In the following, contents of the conveying (feeding) control for the regular sheet will be described along the flowchart of FIG. 9.

At the time when the conveying control for the regular sheet is started, the feeding roller 103 is in an upper position and does not contact the original D1 (part (a) of FIG. 5). When the conveying control is started, the cam 152 is rotated by the cam motor M4, and the feeding roller 103 is lowered and contacted to an upper surface of the original D1 (S201 to S203, part (b) of FIG. 5). Then, when the feeding motor M1 and the conveying motor M2 are rotated (S204), the original D1 is fed in the feeding direction by the feeding roller 103 contacting the original D1 (part (c) of FIG. 5).

Thereafter, a leading end of the original D1 reaches the separation nip between the conveying roller 104 and the separation roller 105, and the original D1 is further conveyed in a separation state from other originals. Then, when detection that the leading end of the original D1 reached the post-separation sensor S2 is made (S205), the feeding roller 103 is raised by rotating the cam motor M4 again, so that the feeding roller 103 is separated and moved away from the original D1 (S206 to S208, part (a) of FIG. 6). The reason why the feeding roller 103 is raised is that a phenomenon such that the original D2 on which the original D1 is superposed is moved together with the original D1 toward the separation nip and buckles by collision with the separation roller 105 and a phenomenon such that the original D2 passes together with the original D1 through the separation nip and thus causes double feeding are avoided. Further, the reason why the feeding roller 103 is raised after detection that the leading end of the original D1 reached the post-separation sensor S2 is made is that the feeding roller 103 is separated and moved away from the original D1 in a state in which conveying of the original D1 is reliably succeeded from the feeding roller 103 to the conveying roller 104.

When the original D1 reaches the drawing roller 106 and the post-drawing sensor S4 detects the leading end of the original D1 (S209), drive of the motor M1 is stopped (S210, part (b) of FIG. 6). Thereafter, the original D1 is conveyed by the drawing roller 106, the lead retard roller 108, the lead discharging roller 111, and the discharging roller 113 which are driven by the conveying motor M2, and thus is discharged onto the discharge tray 114. During the process, an image of the original D1 is read by the scanning unit 122 through the moving reading glass 116. Incidentally, the reason why the drive of the feeding motor M1 is stopped at the time when the post-drawing sensor S4 detects the leading end of the original D1 is that in the case where the subsequent original D2 moves to a detect in the neighborhood of the separation nip, occurrence of the double feeding is prevented.

Here, in the conveying control for the regular sheet, the feeding roller 103 is raised and moved away from the original D1 in S206 to S208, and thereafter, an operation (contact operation) for lowering the feeding roller 103 again at timing when priority is put on productivity is started and prepares for feeding of the subsequent original D2. That is, the conveying control 302 discriminates that the contact operation of the feeding roller 103 is capable of being started if the original D1 is conveyed in a certain distance or more even after the state of part (b) of FIG. 6 and before the post-separation sensor S2 detects passing of the trailing end of the original D1.

In this embodiment, a specific condition that the contact operation of the feeding roller 103 is started is such that on the basis of the time when the post-separation sensor S2 detected the leading end of the original D1, a feeding distance of the original D1 by the separation conveying roller pair 104A is not less than a predetermined distance. The "predetermined distance" is a distance set in advance so as to be equal to a length which is not less than a movement distance from passing of the leading end of the original D1 through the detecting position of the post-separation sensor S2 until the trailing end of the original D1 passes through a contact position P1 of the feeding roller 103. Incidentally, the contact position P1 (part (c) of FIG. 6) of the feeding roller 103 refers to a central position with respect to the feeding direction in a range in which the feeding roller 103 and the original are in contact with each other in the case where the feeding roller 103 is lowered and contacted to the original on the original tray 101.

The conveying distance of the original D1 from the time when the post-separation sensor S2 detects the passing of the leading end of the original D1 can be calculated on the basis of amounts of rotation of the feeding motor M1 and the conveying motor M2 and a peripheral speed ratio of each of the conveying roller 104 and the drawing roller 106 to an angular velocity of the associated motor. Further, a value of the predetermined distance can also be made common to a plurality of regular sizes, but it is suitable that the predetermined distance value is preset for each of the regular sizes different in sheet length. Specifically, regarding the original D1 with a certain length, a theoretical movement distance from passing of the leading end of the original D1 through the detecting position of the post-separation sensor S2 until the trailing end of the original D1 passes through the contact position P1 of the feeding roller 103 is acquired. To this theoretical movement distance, a margin necessary to prevent the feeding roller 103 from contacting the original D1 when the feeding roller 103 is lowered, and a resultant value can be set at the predetermined distance.

The conveying controller 302 monitors the amount of rotation of the feeding motor M1 on the basis of the time when the post-separation sensor S2 detected the passing of the leading end of the original D1 in S207, and calculates the feeding distance of the original D1 by the separation conveying roller pair 104A, and then compares the calculated feeding distance with the above-described predetermined distance (S211). Then, in the case where the feeding distance is not less than the predetermined distance, the conveying controller 302 causes the cam motor M4 to rotate the cam 152, so that the feeding roller 103 is lowered and thus the contact operation in which the feeding roller 103 is contacted to the upper surface of the original D2 is executed (S212 to S214, part (c) of FIG. 6).

Thus, in the conveying control for the regular sheet, even before the post-separation sensor S2 detects the trailing end of the original D1, the contact operation of the feeding roller 103 is started on the basis of the conveying distance of the original D1 and the sheet feeding device prepares for the feeding of the subsequent original D2. At this time, the trailing end of the original D1 has already passed through the contact position D1 of the feeding roller 103, so that the occurrences of the buckling and the double feeding of the original D2 as described above in relation to S206 to S208 are avoided. Further, damage (for example, friction trace due to friction of the feeding roller 103 on the upper surface, of the original D1 on the original tray 101, which is a reading surface to be read by the scanning unit 122) on the original D1 due to falling of the feeding roller 103 on the original D1 is avoided. Further, compared with a constitution in which the contact operation of the feeding roller 103 is started after the post-separation sensor S2 detects the trailing end of the original D1 as in conveying control for a narrow sheet described later, an interval between the trailing end of the current sheet and the leading end of the subsequent sheet is narrowed, so that productivity of the ADF 100 can be improved.

Incidentally, at the time when the feeding roller 103 is lowered and contacted to the subsequent original D2, there is a possibility that the trailing end of the current original D1 does not still pass through the separation nip, in such a case, when feeding of the subsequent original D2 is immediately started, there is a possibility that the originals collide with each other and cause buckling. Therefore, the feeding of the subsequent original D2 is not started until the post-separation sensor S2 detects the passing of the trailing end of the original D1 (S215). In the case where the post-separation sensor S2 detects the passing of the trailing end of the original D1, when the original presence/absence sensor S1 detects the presence of the original on the original tray 101 (S216: YES), it is understood that at least the subsequent original D2 is present. In this case, the feeding of the subsequent original D2 is started by driving the feeding motor M1 (S217), the process is returned to S205 and is continued. On the other hand, in the case where the post-separation sensor S2 detects the passing of the trailing end of the original D1, when the original presence/absence sensor S1 does not detect the presence of the original on the original tray 101 (S216: NO), the conveying controller 302 discriminates that all the originals are fed, and then the conveying operation is ended.

Conveying Operation: Case of Narrow Sheet

Next, the conveying operation of the narrow sheet will be described using FIGS. 5, 7, 8 and 10. FIG. 7 shows a state in the conveying operation in the case where originals D1 and D2 narrow in width such as a bill, a check and a receipt are conveyed. Further, an initial stage of the feeding operation is similar to the initial stage of the case of regular sheet and therefore, description will be made also with reference to FIG. 5.

In the following, the narrow sheet in this embodiment refers to a sheet narrower in width than an A6R sheet (sheet width: 105 mm) with a narrowest regular size met by the ADF 100. Similarly as in the case of the regular size-original, also in the case where the narrow-original is conveyed, the user stacks the originals on the original tray 101 in advance before the user provides an instruction to execute the reading operation to the image reading apparatus 170 and then moves the side restricting plates 203 and 204 in alignment with side ends of the originals. The conveying controller 302 recognizes the sheet width of the originals from a value of an output voltage of the volume sensor 208 by making reference to correspondence between an output voltage and the sheet size of the original which are stored in the memory 305 in advance. At this time, an output voltage of the volume sensor 208 shows that the sheet width of the original is further narrower than the sheet width of the narrowest regular size, and thus it turns out that the original stacked on the original tray 101 is the narrow sheet.

When the instruction to execute the reading operation is provided to the image reading apparatus 170, the conveying controller 302 causes the ADF 100 to start a process for conveying the originals ("START" of FIG. 8). At this time, when the original is identified as the narrow sheet by a detection result of the volume sensor 208, a sequence (F3) of FIG. 10 which is conveying control (operation in a second mode in this embodiment) for the narrow sheet is started. In this embodiment, in the case where the sheet width of the original detected by the volume sensor 208 is less than a preset threshold (less than 105 mm) (S101: YES), the original is treated as the narrow sheet, not the regular sheet with the regular size.

Here, as regards the narrow sheet, different from the regular sheet, even when the sheet width of the original is known, the sheet length with respect to the feeding direction is not defined. Accordingly, as described above in the conveying control for the regular sheet, when the feeding roller is lowered on the basis of the feeding distance of the current original after the feeding roller is raised after the start of the feeding of the current original, the feeding roller falls and lands on the current original, so that there is a possibility of the occurrences of the buckling and the double feeding for the subsequent original. Therefore, in the conveying control for the narrow sheet, the feeding roller is lowered in the case where the post-separation sensor S2 detects the trailing end of the current original.

In the following, contents of the conveying control for the narrow sheet will be described along the flowchart of FIG. 10. Incidentally, process contents of S301 to S310 in FIG. 10 are similar to the process contents (of S201 to S210 in FIG. 9) in the conveying control for the regular sheet.

At the time when the conveying control for the narrow sheet is started, the feeding roller 103 is in the upper position which is the home position and does not contact the original D1 (part (a) of FIG. 5). When the conveying control is started, first, the cam 152 is rotated by the cam motor M4, and the feeding roller 103 is lowered and contacted to the upper surface of the original D1 (S301 to S303, part (b) of FIG. 5). Then, when the feeding motor M1 and the conveying motor M2 are rotated (S304), the original D1 is fed in the feeding direction by the feeding roller 103 contacting the original D1 (part (c) of FIG. 5).

Thereafter, the leading end of the original D1 reaches the separation nip between the conveying roller 104 and the separation roller 105 and is further conveyed in a separated state from other originals. Then, when detection that the leading end of the original D1 reached the post-separation sensor S2 (S305), the feeding roller 103 is raised by rotating the cam motor M4 again and thus is moved away from the original D1 (S306 to S308, part (a) of FIG. 7. The reason why the feeding roller 103 is raised and timing of the raising of the feeding roller 103 are similar to those in the case of the regular sheet.

When the original D1 reaches the drawing roller 106 and the post-drawing sensor S4 detects the leading end of the original D1 (S309), the drive of the feeding motor M1 is stopped (S310, part (b) of FIG. 7).

Thereafter, the original D1 is conveyed by the drawing roller 106, the lead roller 108, the lead discharging roller 111 and the discharging roller 113 which are driven by the conveying motor M2, and thus is discharged onto the discharge tray 114. During the process, an image of the original D1 is read by the scanning unit 122 through the moving reading glass 116.

Here, in the conveying control for the narrow sheet, the lowering of the feeding roller 103 based on the feeding distance of the original D1 from the time of detection of the leading end of the original D1 by the post-separation sensor S2 is not performed, the sheet feeding device is on standby until the post-separation sensor S2 detects the trailing end of the original D1. Accordingly, as shown in part (c) of FIG. 7, even when the trailing end of the original D1 passed through the contact position P1 of the feeding roller 103 in actuality, the lowering of the feeding roller 103 is not performed immediately in the conveying control for the narrow sheet.

Thereafter, in the case where the post-separation sensor S2 detects the passing of the trailing end of the original D1 (S311: YES), when the original presence/absence sensor S1 detects the presence of the original on the original tray 101 (S312: YES), it is understood that at least the subsequent original D2 is present. In this case, the contact in which the cam 152 is rotated by the cam motor M4 and thus the feeding roller 103 is lowered and contacted to the upper surface of the subsequent original D2 is carried out (S313 to S315, part (d) of FIG. 7). Immediately after the lowering of the feeding roller 103 is ended, the feeding of the subsequent original D2 is started by driving the feeding motor M1 (S316), the process is returned to S305 and is continued. On the other hand, in the case where the post-separation sensor S2 detects the passing of the trailing end of the original D1, when the original presence/absence sensor S1 does not detect the presence of the original on the original tray 101 (S312: NO), the conveying controller 302 discriminates that all the originals are fed, and then the conveying operation is ended.

Thus, in the conveying control for the narrow sheet, the sheet feeding device is on standby until the post-separation sensor S2 detects the trailing end of the current original D1, and then executes the contact operation of the feeding roller 103 in preparation for feeding of the subsequent original D2. By employing such a constitution, even in the case of the narrow sheet with an unknown sheet length, it is possible to realize a stable feeding operation. That is, in the case where a plurality of originals which are narrow sheets and which are different in sheet length are fed, an operation in the first mode is carried out.

Summary of this Embodiment

As described above, in this embodiment, on the basis of the detection results of the volume sensor 208 and the original length sensor S3, the conveying control for the regular sheet and the conveying control for the narrow sheet which are different in lowering timing of the feeding roller 103 are switched. In other words, on the basis of the information acquired by the size acquiring portion, the operation in the first mode and the operation in the second mode which are different in timing when the contact operation of the feeding portion is performed after the feeding of the current sheet is started and then the separating operation of the feeding portion is executed is selectively carried out.

In the conveying control for the narrow sheet corresponding to the operation in the first mode, the feeding roller is lowered in the case where the passing of the trailing end of the current original is detected by the post-separation sensor S2, and therefore, irrespective of the length of the original, a stable feeding operation is realized. On the other hand, in the conveying control for the regular sheet corresponding to the operation in the second mode, before the detection of the trailing end of the current original by the post-separation sensor S2, the feeding roller 103 is lowered on the basis of the feeding distance of the current original, and therefore, although determination of the size of the original is needed, high productivity is achieved. Accordingly, by the constitution of this embodiment, it becomes possible to compatibly realize the improvement in productivity and the improvement in stability of the feeding operation.

Modified Embodiments

In the above-described embodiment, as an example of the sheet width detecting portion constituting the size acquiring portion, the volume sensor 208 was described. Instead of this, for example, at least one photo-interrupter is provided correspondingly to positions of the side restricting plates 203 and 204 which correspond to the regular size, and the sheet width may also be detected by detecting flags provided on the side restricting plates with the photo-interrupter. Further, the size acquiring portion is not limited to one mounted on the stacking portion such as the original tray 101 or the like, but for example, the operation in the mode of the conveying control for the ADF 100 may also be changed on the basis of the size of the original inputted by the user through an operating panel of the image forming apparatus 10. In this case, the operating panel displaying a screen as an input screen of the size of the original and receiving the input of the user is another example of the size acquiring portion.

Further, in the above-described embodiment, in the case where the sheet width is A6R or more, the size of the original is regarded as being corresponding to either one of the regular sizes, and in the case where the original is detected as being an original narrower in width than the A6R, the conveying control for the narrow sheet in which the stable conveying operation is performed irrespective of the length of the original is employed. However, it is assumed that the original has a width broader in width than a narrowest size of the regular sizes of the sheets feedable by the ADF 100 and has an irregular length, control for such an original which is the same in contents as the conveying control for the narrow sheet may also be employed. That is, the operation in the mode of the conveying control may also be changed depending on whether the information, on the size of the sheet on the original tray, acquired by the size acquiring portion corresponds to which one of the plurality of sizes set in advance by being registered in the memory 305 before shipping or the like method.

For example, the controller discriminates that the size of the original is the regular size when the output signal of the volume sensor 208 falls within a certain error range of a value accurately corresponding to the sheet width of the regular size-sheet, and discriminates that the size of the original is an irregular size when the output signal does not fall within the error image of either one of the regular sizes. In this case, when the original with the irregular size is fed, by employing the control which is the same in contents as the conveying control for the narrow sheet in the above-described embodiment, the stable conveying operation can be realized irrespective of an actual size of the original. Further, in the case of the above-described modified embodiment using the operating panel as the size acquiring portion, when information indicating that the size of the original is indeterminate ("free size", "irregular size" or the like) is inputted, it would be considered that the control which is the same in contents as the conveying control for the narrow sheet is employed.

Further, in the conveying control for the regular sheet in the above-described embodiment, the feeding distance of the original is calculated on the basis of the timing when the post-separation sensor S2 detected the leading end of the current original (S211 of FIG. 9). Instead of this, for example, the feeding distance of the original may also be calculated on the basis of the amount of rotation of the feeding motor M1 from the start of the drive of the feeding motor M1. That is, in the conveying control for the regular size-sheet, irrespective of the calculating method of the conveying distance of the original, the contact operation of the feeding roller can be started in the case where it is conformed that the original is fed in a distance in which the trailing end of the current original passes through at least the contact position of the feeding roller.

Further, in the conveying control for the narrow sheet in the above-described embodiment, in the case where the post-separation sensor S2 exclusively detected the trailing end of the original, the contact operation of the feeding roller is started in preparation for the feeding of the subsequent original. Instead of this, it would be considered that a pre-separation sensor for detecting the original on a side downstream of the set position of the original and upstream of the separation nip on the original tray 101 is provided. In this case, in the case where either one of the pre-separation sensor and the post-separation sensor S2 detected the trailing end of the current original, when the constitution in which the contact operation of the feeding roller is started in preparation for the feeding of the subsequent original is employed, improvement of productivity in the conveying control for the narrow sheet is expected.

Further, in the above-described embodiment, as the mode in the conveying operation of the original by the ADF 100, two modes consisting of the conveying control for the regular sheet and the conveying control for the narrow sheet were described as examples, but three or more modes including modes other than these modes may also be selectively executed.

In the above-described embodiment, as an example of the sheet feeding device, the contents of the present invention was described by citing the ADF 100 for feeding the sheet which is the original in the image reading apparatus. The present invention is not limited thereto, but may also be applicable to a sheet feeding device for feeding a sheet used as a recording material in an image forming apparatus, for example.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-127770 filed on Jul. 9, 2019, which is hereby incorporated by reference herein in its entirety.

What is claimed is:

1. A sheet feeding device comprising:

a stacking portion configured to stack a sheet;

a feeding portion configured to feed the sheet stacked on said stacking portion in a feeding direction in contact with the sheet;

a moving mechanism configured to move said feeding portion between (a) a contact position where said feeding portion contacts the sheet stacked on said stacking portion and (b) a separated position where said feeding portion is separated from the sheet stacked on said stacking portion;

a separating portion configured to convey the sheet fed by said feeding portion while separating the sheet from a subsequent sheet stacked under the sheet on the stacking portion;

a detecting portion configured to detect the sheet at a detecting position positioned downstream of said feeding portion with respect to the feeding direction;

an acquiring portion configured to acquire information including a sheet width, with respect to a widthwise direction perpendicular to the feeding direction, of the sheet stacked on said stacking portion; and a controller configured to execute a contact operation in which said controller causes said moving mechanism to move said feeding portion from the separated position to the contact position, wherein in a case that the sheet width acquired by said acquiring portion is a first width, said controller starts the contact operation, so as to feed the subsequent sheet, on the basis of detection of a trailing end of the sheet by said detecting portion, and wherein in a case that the sheet width acquired by said acquiring portion is a second width broader than the first width, said controller starts the contact operation, so as to feed the subsequent sheet, before the trailing end of the sheet passes the detecting position.

2. A sheet feeding device according to claim 1, wherein said acquiring portion includes a sheet width detecting portion provided to said stacking portion and configured to detect the sheet width of the sheet stacked on said stacking portion.

3. A sheet feeding device according to claim 2, further comprising a side end restricting portion provided on said stacking portion so as to be movable in the widthwise direction and configured to restrict a position, with respect to the widthwise direction, of the sheet stacked on said stacking portion, wherein said sheet width detecting portion detects the sheet width based on a position of said side end restricting portion.

4. A sheet feeding device according to claim 1, wherein in a case that the information acquired by said acquiring portion indicates that a size of the sheet stacked on the stacking portion does not correspond to any one of a plurality of preset sizes, said controller starts the contact operation, so as to feed the subsequent sheet, on the basis of detection of the trailing end of the sheet by said detecting portion, and wherein in a case that the information acquired by said acquiring portion indicates that the size of the sheet stacked on the stacking portion corresponds to any one of the plurality of preset sizes, said controller starts the contact operation, so to feed the subsequent sheet, before the trailing end of the sheet passes the detecting position.

5. A sheet feeding device according to claim 1, further comprising:

a first driving source configured to drive said feeding portion and to feed the sheet; and a second driving source configured to drive said moving mechanism and to cause said moving mechanism to perform the contact operation, wherein in a case that the sheet width acquired by said acquiring portion is the second width, the contact operation is executed by causing said second driving source to drive said moving mechanism before said detecting portion detects passing of the trailing end of the sheet, and drive of said feeding portion by said first driving source is started after said feeding portion is on standby until said detecting portion detects the passing of the trailing end of the sheet.

6. A sheet feeding device according to claim 5, further comprising:

a downstream conveying portion configured to convey the sheet on a side downstream of said separating portion with respect to the feeding direction;

a third driving source configured to drive said downstream conveying portion; and a downstream detecting portion configured to detect the sheet on a side downstream of said downstream conveying portion, wherein said first driving source is configured to drive said separating portion, and wherein after said controller causes said feeding portion to feed the sheet, on the basis of detection of a leading end of the sheet by said detecting portion, said controller causes said second driving source to drive said moving mechanism and thus causes said moving mechanism to execute the separating operation, and thereafter said controller causes said first driving source to stop the drive of said feeding portion on the basis of detection of the leading end of the sheet by said downstream detecting portion.

7. A sheet feeding device according to claim 1, wherein said feeding portion is a feeding roller supported by a swingable member which is swingable upward and downward, wherein said moving mechanism is configured to move said feeding roller relative to said stacking portion by swinging said swingable member, and wherein said separating portion includes a conveying roller configured to convey the sheet in the feeding direction and a separating portion configured to form said separating portion between itself and said conveying roller and configured to separate the sheet by imparting a frictional force to the sheet passing through said separating portion.

8. A sheet feeding device according to claim 1, wherein said detecting portion detects the sheet on a side downstream of said separating portion with respect to the feeding direction.

9. A sheet feeding device according to claim 1, wherein in a case that the sheet width acquired by said acquiring portion is the second width, said controller starts the contact operation, so as to feed the subsequent sheet, on the basis of a distance in which the sheet is fed by said separating portion.

10. A sheet feeding device according to claim 9, wherein said controller is configured to start the contact operation in a case that the distance in which the sheet is fed by said separating portion from a time when said detecting portion detects a leading end of the sheet is not less than a predetermined distance, and wherein the predetermined distance is set at a length which is not less than a movement distance of the sheet from passing of the leading end of the sheet through the detecting position of said detecting portion until the trailing end of the sheet passes through a position where the feeding portion contacts the sheet stacked on the stacking portion in a case that the contact operation is performed.

11. A sheet feeding device according to claim 10, wherein said acquiring portion includes a sheet length detecting portion provided to said stacking portion and configured to detect information on a length, with respect to the feeding direction, of the sheet stacked on the stacking portion, and wherein a value of the predetermined distance is changed depending on a detection result of said sheet length detecting portion.

12. A sheet feeding device according to claim 1, wherein said controller is configured to execute a separating operation in which said controller causes said moving mechanism to move said feeding portion from the contact position to the separated position.

13. An image reading apparatus comprising:

a stacking portion configured to stack a sheet;

a feeding portion configured to feed the sheet stacked on said stacking portion in a feeding direction in contact with the sheet;

a moving mechanism configured to move said feeding portion between (a) a contact position where said feeding portion contacts the sheet stacked on said stacking portion and (b) a separated position where said feeding portion is separated from the sheet stacked on said stacking portion;

a separating portion configured to convey the sheet fed by said feeding portion while separating the sheet from a subsequent sheet stacked under the sheet on the stacking portion;

a detecting portion configured to detect the sheet at a detecting position positioned downstream of said feeding portion with respect to the feeding direction;

an acquiring portion configured to acquire information including a sheet width, with respect to a widthwise direction perpendicular to the feeding direction, of the sheet stacked on said stacking portion;

a controller configured to execute a contact operation in which said controller causes said moving mechanism to move said feeding portion from the separated position to the contact position; and a reading portion configured to read an image on a sheet fed by said feeding portion, wherein in a case that the sheet width acquired by said acquiring portion is a first width, said controller starts the contact operation, so as to feed the subsequent sheet, on the basis of detection of a trailing end of the sheet by said detecting portion, and wherein in a case that the sheet width acquired by said acquiring portion is a second width broader than the first width, said controller starts the contact operation, so as to feed the subsequent sheet, before the trailing end of the sheet passes the detecting position.

14. An image forming apparatus comprising:

a stacking portion configured to stack a sheet;

a feeding portion configured to feed the sheet stacked on said stacking portion in a feeding direction in contact with the sheet;

a moving mechanism configured to move said feeding portion between (a) a contact position where said feeding portion contacts the sheet stacked on said stacking portion and (b) a separated position where said feeding portion is separated from the sheet stacked on said stacking portion;

a separating portion configured to convey the sheet fed by said feeding portion while separating the sheet from a subsequent sheet stacked under the sheet on the stacking portion;

a detecting portion configured to detect the sheet at a detecting position positioned downstream of said feeding portion with respect to the feeding direction;

an acquiring portion configured to acquire information including a sheet width, with respect to a widthwise direction perpendicular to the feeding direction, of the sheet stacked on said stacking portion;

a controller configured to execute a contact operation in which said controller causes said moving mechanism to move said feeding portion from the separated position to the contact position;

a reading portion configured to read an image on a sheet fed by said feeding portion; and an image forming portion configured to form an image on a recording material, wherein in a case that the sheet width acquired by said acquiring portion is a first width, said controller starts the contact operation, so as to feed the subsequent sheet, on the basis of detection of a trailing end of the sheet by said detecting portion, and wherein in a case that the sheet width acquired by said acquiring portion is a second width broader than the first width, said controller starts the contact operation, so as to feed the subsequent sheet, before the trailing end of the sheet passes the detecting position.

* * * * *